US009217967B2

(12) United States Patent
Kim et al.

(10) Patent No.: US 9,217,967 B2
(45) Date of Patent: Dec. 22, 2015

(54) FUSING DEVICE AND METHOD USING INDUCTION HEATING AND IMAGE FORMING APPARAUS INCLUDING THE FUSING DEVICE

(71) Applicant: SAMSUNG ELECTRONICS CO., LTD., Suwon-si, Gyeonggi-do (KR)

(72) Inventors: Dae-hwan Kim, Seoul (KR); Keon Kuk, Yongin-si (KR); Jin-han Kim, Suwon-si (KR); Tatsuhiro Otsuka, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 205 days.

(21) Appl. No.: 13/624,171

(22) Filed: Sep. 21, 2012

(65) Prior Publication Data

US 2013/0078019 A1 Mar. 28, 2013

(30) Foreign Application Priority Data

Sep. 22, 2011 (KR) ..... 10-2011-0095895

(51) Int. Cl.
*G03G 15/20* (2006.01)

(52) U.S. Cl.
CPC ..... *G03G 15/2053* (2013.01); *G03G 15/2042* (2013.01)

(58) Field of Classification Search
CPC ..... G03G 15/2053; G03G 15/2042
USPC ..... 219/216, 661, 662; 399/330
See application file for complete search history.

(56) References Cited

U.S. PATENT DOCUMENTS 6,320,168 B1 * 11/2001 Kimata et al. ..... 219/619
6,724,999 B2 4/2004 Kikuchi et al.
7,215,919 B2 5/2007 Kinouchi et al.
7,268,327 B2 9/2007 Yamamoto et al.

(Continued)

FOREIGN PATENT DOCUMENTS

EP 2 388 657 11/2011
JP 2000-215976 8/2000

(Continued)

OTHER PUBLICATIONS

Magnetic Fields Due to a Solenoid, available at http://plasma.kulgun.net/sol_page (retrieved Aug. 29, 2014).*

(Continued)

*Primary Examiner* — David Gray
*Assistant Examiner* — Sevan A Aydin
(74) *Attorney, Agent, or Firm* — Staas & Halsey LLP

(57) ABSTRACT

An induction heating fusing device and method of an image forming apparatus including: a pressure roller; a heating element that forms a fusing nip together with the pressure roller and is rotatable; an inductor that is installed in a rotation axis direction on the outer circumference surface of the heating element, includes a main coil and a plurality of control coils located on the main coil, and inductively heats the heating element; and a controller that selectively drives at least one of the plurality of control coils depending on the width of a printing paper passing though the fusing nip, and controls the main coil and the plurality of control coils so that a current direction of the main coil and a current direction of the plurality of control coils become the same as or opposite to each other depending on the width of the printing paper.

20 Claims, 14 Drawing Sheets

(56) References Cited

U.S. PATENT DOCUMENTS

| | | | | |
|---|---|---|---|---|
| 7,319,840 | B2 | 1/2008 | Matsumoto | |
| 7,450,872 | B2 | 11/2008 | Ueno et al. | |
| 7,835,680 | B2 | 11/2010 | Nanjo et al. | |
| 7,949,290 | B2 | 5/2011 | Yoshikawa | |
| 2005/0152720 | A1* | 7/2005 | Katakabe et al. | 399/330 |
| 2010/0061753 | A1* | 3/2010 | Hase | 399/69 |
| 2010/0258557 | A1* | 10/2010 | Kinouchi et al. | 219/671 |
| 2011/0280601 | A1* | 11/2011 | Kim et al. | 399/45 |

FOREIGN PATENT DOCUMENTS

| | | |
|---|---|---|
| JP | 2001-34097 | 2/2001 |
| JP | 2010-244054 | 10/2010 |
| KR | 10-2011-0131803 | 12/2011 |

OTHER PUBLICATIONS

European Search Report in Application No. 12185534.0 dated Apr. 3, 2014 (6 pages).

* cited by examiner $$\frac{V_P}{V_S} = \frac{I_S}{I_P} = \frac{N_P}{N_S}$$

FUSING DEVICE AND METHOD USING INDUCTION HEATING AND IMAGE FORMING APPARAUS INCLUDING THE FUSING DEVICE

CROSS-REFERENCE TO RELATED APPLICATIONS

This application claims the benefit of Korean Patent Application No. 10-2011-0095895, filed on Sep. 22, 2011, in the Korean Intellectual Property Office, the disclosure of which is incorporated herein in its entirety by reference.

BACKGROUND

1. Field

The present general inventive concept relates to an image forming apparatus, and more particularly, to a fusing device and method using induction heating and an image forming apparatus including the fusing device.

2. Description of the Related Art

FIG. 1 is a schematic diagram illustrating processes of an electro photographic type printer system. An electrostatic latent image is formed on the surface of an optical OPC drum 10 by electrifying the OPC drum 10 (operation 1) and then exposing the surface thereof (operation 2). Then, the electrostatic latent image formed on the OPC drum 10 is developed into a toner image (operation 3). The toner image is transferred on a print medium (operation 4), and the toner image transferred onto the print medium is fused onto the print medium through fusing (operation 7). When the fusing is finished, erasing is performed (operation 6) after cleaning the toner remaining on the OPC drum 10 (operation 5).

In the fusing operation, the toner image is fused onto the print medium by heat and pressure between a fusing belt/roller and a pressure roller. A method of heating a fusing belt/roller by using a halogen lamp or an induction heating method is mainly used as a heating method. In the induction heating method, since only the surface of the fusing belt/roller is heated, it is possible to reduce a time necessary to raise the temperature of a fuser (not shown) compared to the method of heating the fusing belt/roller by using a halogen lamp.

In the induction heating method, since the heating belt/roller is heated by an induction current that is generated by an inductor composed of an induction coil and a ferrite, the elements of the fusing belt/roller is formed of a magnetic material such as nickel or Steel Use Stainless (SUS) 430. However, when an internal coil type induction heating method is used, an induction coil in an induction heating (IH) fuser is located inside a heating roller, similar to the method of heating by using a halogen lamp. A large period of time is required for heat generated from an internal heating element to reach the surface of the heating roller, and the cost may increase since the induction coil, which is generally expensive, and the ferrite should be replaced together with the heating roller when the heating roller needs to be replaced.

In order to overcome this shortcoming, an external coil type induction heating method in which an inductor composed of an induction coil and a ferrite is located outside a heating roller is mainly used in the IH fuser. In the external coil type induction heating method, only the heating roller may be replaced without replacing the expensive inductor when it is necessary to replace a fuser.

As illustrated in FIG. 2, in a fuser using the external coil type induction heating method in which an induction coil is disposed outside a heating roller, the induction coil is rolled in a horseshoe-like shape at both ends of the heating roller. Due to this, the heating performance of the both ends of the heating roller is deteriorated, and it is necessary to increase the length of the heating roller/belt compared to the method of heating by using a halogen lamp. As a result, the length of the heating roller/belt of the IH fuser is increased compared to other type fusers, and thus, a printer employing the IH fuser becomes larger.

In addition, in the induction heating method, since the heating belt is thin, heating an area of the heating belt on which a printing paper passes is transmitted to the printing paper. Thus, when a printing paper having a small size such as B5 or A6 size that is smaller than A3 size is continuously printed, heat of an area of the heating belt on which the printing paper does not pass is accumulated, Therefore, the temperature of the area of the heating belt on which the printing paper does not pass excessively rises. Thus, the induction heating method is less advantageous than the method of heating by using a halogen lamp in coping with various types of printing papers.

SUMMARY

Additional aspects and/or advantages will be set forth in part in the description which follows and, in part, will be apparent from the description, or may be learned by practice of the invention.

The present disclosure provides an induction heating fusing device for coping with various types of printing papers by controlling a degaussing area of a control coil functioning as a degaussing coil when the control coil operates and for preventing the length of a heating roller from increasing by controlling the control coil so as to be used also as an excitation coil.

The present disclosure also provides an induction heating fusing method for coping with various types of printing papers by controlling a degaussing area of a control coil functioning as a degaussing coil when the control coil operates and for preventing the length of a heating roller from increasing by controlling the control coil so as to be used also as an excitation coil.

The present disclosure also provides an image forming apparatus including the induction heating fusing device.

According to an aspect, there is provided an induction heating fusing device including: a pressure roller; a heating element that forms a fusing nip together with the pressure roller and is rotatable; an inductor that is installed in a rotation axis direction on the outer circumference surface of the heating element, includes a main coil and a plurality of control coils, and inductively heats the heating element; and a controller that selectively drives at least one of the plurality of control coils depending on the width of a printing paper passing though the fusing nip, and controls the main coil and the plurality of control coils so that a current direction of the main coil and a current direction of the plurality of control coils become the same as or opposite to each other depending on the width of the printing paper.

The inductor may include: the main coil that is installed in the rotation axis direction on the outer circumference surface of the heating element, and operates as an excitation coil; the plurality of control coils that are located on the main coil, are selectively driven depending on the width of the printing paper, and operate as excitation coils or degaussing coils depending on a current direction thereof due to the control of the controller; and a focusing core that focuses an electromagnetic field generated by a current flowing through the main coil and the plurality of control coils onto the heating element.

The controller may include: a plurality of switching devices that switch connections between the main coil and the plurality of control coils; and an inductor control unit that selectively control the plurality of switching devices according to the width of the printing paper to make the current direction of the main coil and the current direction of the plurality of control coils be the same as or opposite to each other.

According to an aspect, there is provided an induction heating fusing method including: installing a main coil in a rotation axis direction on the outer circumference surface of a heating element that forms a fusing nip together with a pressure roller, and disposing a plurality of control coils in the rotation axis direction on the main coil to inductively heat the heating element; selecting at least one of the plurality of control coils depending on the width of a printing paper passing though the fusing nip; controlling the main coil and the plurality of control coils so that a current direction of the main coil and a current direction of the selected at least one of the plurality of control coils become the same as or opposite to each other depending on the width of the printing paper; and fusing an image on the printing paper by heating the heating element via an induction current that is generated by the main coil and the selected at least one of the plurality of control coils.

According to another aspect, there is provided an image forming apparatus including: an image forming unit that forms a toner image and then transfers the toner image onto a printing paper; an induction heating fusing unit that fuses the transferred toner image on the printing paper by using a heating element that is inductively heated and a pressure roller depending on the width of the printing paper; and a power supplying unit that supplies power to the image forming unit and the induction heating fusing unit, wherein the induction heating fusing unit includes: a pressure roller; a heating element that forms a fusing nip together with the pressure roller and is rotatable; an inductor that is installed in a rotation axis direction on the outer circumference surface of the heating element, includes a main coil and a plurality of control coils, and inductively heats the heating element; and a controller that selectively drives at least one of the plurality of control coils depending on the width of a printing paper passing though the fusing nip, and controls the main coil and the plurality of control coils so that a current direction of the main coil and a current direction of the plurality of control coils become the same as or opposite to each other depending on the width of the printing paper.

By using the induction heating fusing device and method according to the present general inventive concept, it is possible to improve the uniformity of a fusing temperature of an axis direction of a heating belt by selectively using control coils as excitation coils or degaussing coils by using switching devices such as relays.

In addition, it is possible to reduce the length of a fuser by applying a current in a direction that is the same as that of a current of a main coil to the control coils to suppress the deterioration of the heating performance at an end of the main coil. Thus, the size of an image forming apparatus using the induction heating fusing device may be reduced. In addition, it is possible to cope with various types of printing papers by changing a method of controlling the control coils.

That is, in the induction heating fusing device and method according to the present general inventive concept, an induction current may be induced in the control coils by constituting a closed circuit including the control coils when the control coils operate as degaussing coils to cope with various types of printing papers. In addition, a degaussing area may be controlled by allowing a current in an amount equal to that of the current of the main coil functioning as excitation coil to flow through the control coils. Thus, it is possible to cope with various types of printing papers. Furthermore, it is possible to prevent the length of a heating roller from increasing by controlling the control coils so as to be used also as excitation coils.

BRIEF DESCRIPTION OF THE DRAWINGS

The above and other features and advantages of the present general inventive concept will become more apparent by describing in detail exemplary embodiments thereof with reference to the attached drawings in which.

Figure 1:
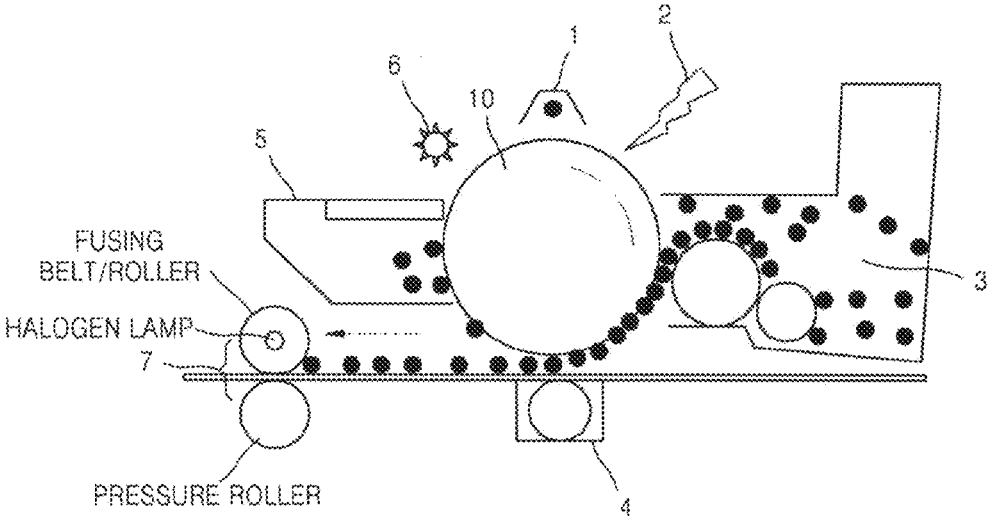
FIG. 1 (RELATED ART)
FIG. 1 is a schematic diagram illustrating processes of an electro photographic type printer system.
Figure 2:
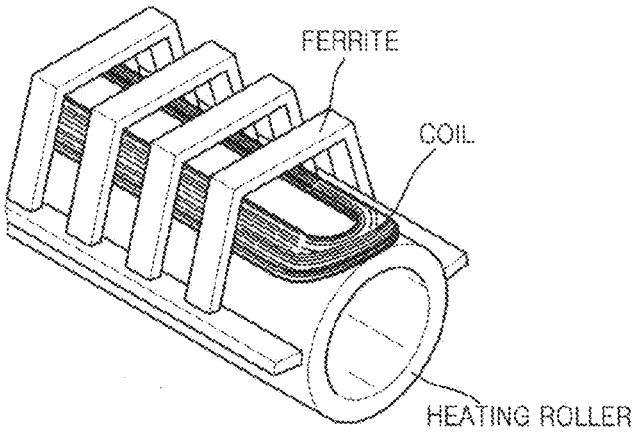
FIG. 2 (RELATED ART)
FIG. 2 illustrates a portion of an external coil type fuser where an induction coil is disposed outside a heating roller.

The present disclosure will now be described more fully with reference to the accompanying drawings, in which exemplary embodiments of the present general inventive concept are shown. The detailed description set forth below and constructions shown in the drawings are intended to be a description of exemplary embodiments of the general inventive concept and are not intended to represent the only forms in which the general inventive concept will be constructed. That is, it is to be understood that equivalent alternatives or modifications will be easily conceivable for those skilled in the art at the time of filing the general inventive concept. Expressions such as "at least one of," when preceding a list of elements, modify the entire list of elements and do not modify the individual elements of the list.

A method of forming a nip in a fuser includes a method of forming a nip by using a heating belt, which generates heat, and a pressure roller and a method of forming a nip by using a heating roller and a pressure roller. A method of generating heat in the fuser includes a method of heating a heating belt or a heating roller through a radiation heating by a halogen lamp located in the fuser, a method of generating heat through a resistor heating by locally attaching a ceramic heater, which is a resistor heater, around a nip, and an induction heating (IH) method of rapidly heating a fusing roller or a surface of a fusing belt by generating an induction current in an inductor composed of a ferrite and an induction coil.

A heating belt/roller that is heated by the heating method using a halogen lamp basically includes a belt/roller pipe, an elastomer, and a releasing layer. In this case, the belt/roller pipe is heated by a radiation heating, and a heat generated at the belt/roller pipe is transmitted to the surface of the heating belt/roller through the elastomer and the releasing layer. The elastomer is needed to provide elasticity necessary to fuse a color image. However, since the thermal conductivity of the elastomer is very low, a speed at which a heat generated at the belt/roller pipe is transmitted to the surface is reduced, and thus, a time necessary to raise the temperature of the fuser is lengthened.

Accordingly, if it is necessary to increase the printing speed of printer, use of a fuser using a halogen lamp is limited. Thus, the induction heating method which is capable of rapidly heating the surface of the heating roller of the fuser is mainly used to provide a high printing speed.

Figure 3:
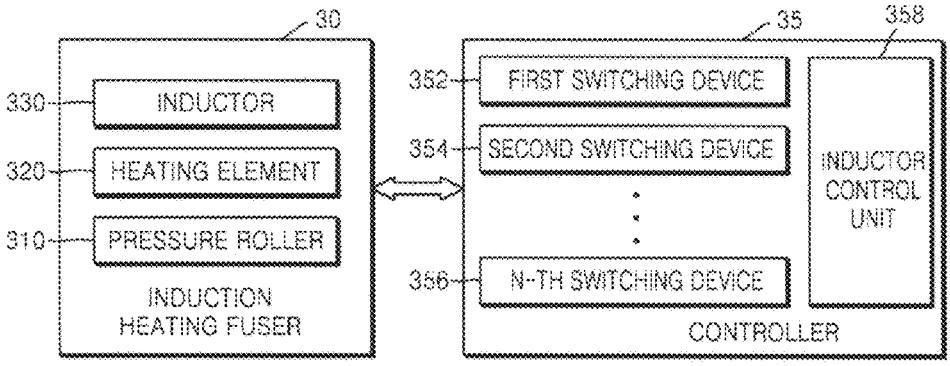
FIG. 3 is a block diagram illustrating a configuration of an induction heating fusing device according to an embodiment of the present general inventive concept.

FIG. 3 is a block diagram illustrating a configuration of an induction heating fusing device according to an embodiment of the present general inventive concept. The induction heating fusing device includes an induction heating fuser 30 and a controller 35. The induction heating fuser 30 is a module for fusing a transferred toner image on a printing medium such as a printing paper, and includes a pressure roller 310, a heating element 320, and an inductor 330.

The pressure roller 310 applies pressure on the transferred toner image to fuse the transferred toner image on a printing medium.

The heating element 320 applies heat to the transferred toner image, and fuses the transferred toner image on a printing medium by forming a fusing nip together with the pressure roller 310. A rotatable heating roller or heating belt may be used as the heating element 320.

The inductor 330 is installed in a rotation axis direction on the outer circumference surface of the heating element 320, and includes a main coil and a control coil to heat the heating element 320 by using an induction method.

Figure 4:
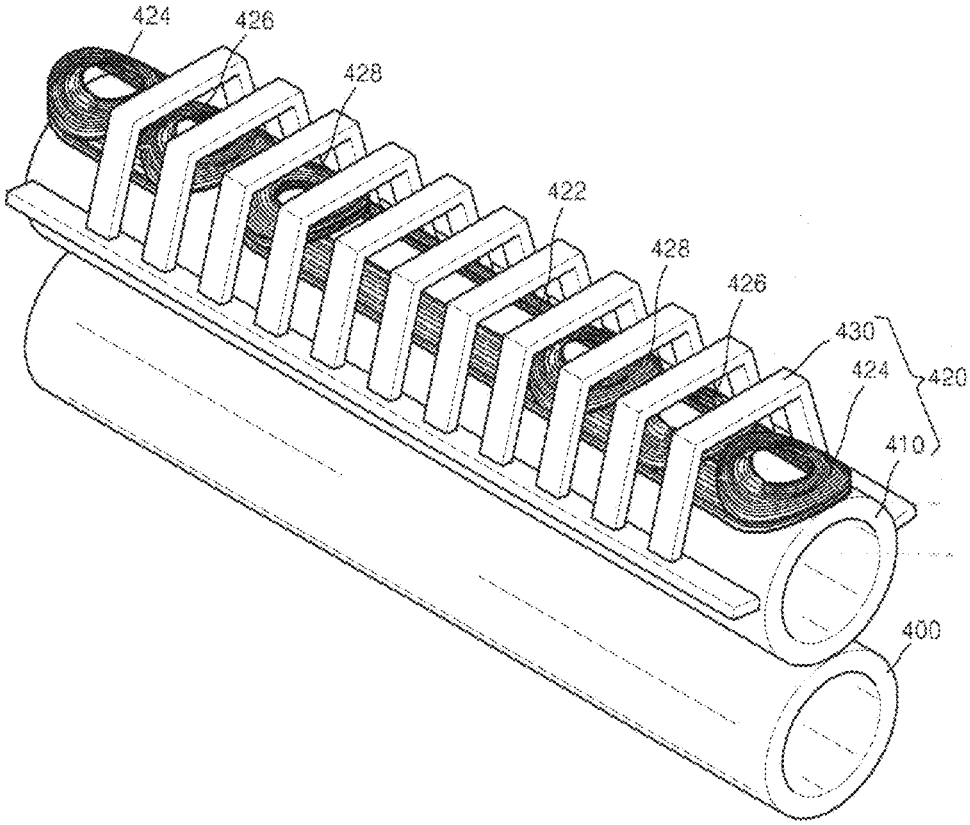
FIG. 4 illustrates an induction heating fuser of FIG. 3, according to an embodiment of the present general inventive concept.

FIG. 4 illustrates the induction heating fuser 30 of FIG. 3, according to an embodiment. The induction heating fuser 30 includes a pressure roller 400, a heating roller 410, and an inductor 420. The inductor 420 may include a main coil 422, a plurality of control coils 424, 426, and 428, and a focusing core 430.

The main coil 422 is installed in the rotation axis direction on the outer circumference surface of the heating element 320, and operates as an excitation coil.

The plurality of control coils 424, 426, and 428 are located on the main coil 422, and at least one of the plurality of control coils 424, 426, and 428 is selectively driven depending on the width of a printing paper. The plurality of control coils 424, 426, and 428 operate as excitation coils or degaussing coils depending on a current direction thereof under the control of the controller 35.

The focusing core 430 focuses an electromagnetic field generated by a current flowing through the main coil 422 and the plurality of control coils 424, 426, and 428 onto the heating element 410, and a ferrite may be used as the focusing core 430.

The controller 35 selectively drives at least one of the plurality of control coils 424, 426, and 428 depending on the width of a printing paper passing though the fusing nip, and controls the main coil 422 and the plurality of control coils 424, 426, and 428 so that a current direction of the main coil 422 and a current direction of the plurality of control coils 424, 426, and 428 become the same as or opposite to each other depending on the width of the printing paper.

The controller 35 may include a plurality of switching devices 352, 354, and 356 and an inductor control unit 358.

The plurality of switching devices 352, 354, and 356 switch connections between the main coil 422 and the plurality of control coils 424, 426, and 428.

The inductor control unit 358 selectively controls the plurality of switching devices 352, 354, and 356 according to the width of the printing paper to make the current direction of the main coil 422 and the current direction of the plurality of control coils 424, 426, and 428 be the same as or opposite to each other. When the inductor control unit 358 drives the plurality of control coils 424, 426, and 428 as degaussing coils, the inductor control unit 358 selectively controls the plurality of switching devices 352, 354, and 356 to constitute a closed circuit including the main coil 422 and the plurality of control coils 424, 426, and 428. In addition, the inductor control unit 358 may operate the main coil 422 and the plurality of control coils 424, 426, and 428 as a primary coil and a secondary coil of a transformer, respectively, so that a larger current flows through the control coils 424, 426, and 428.

Figure 5:
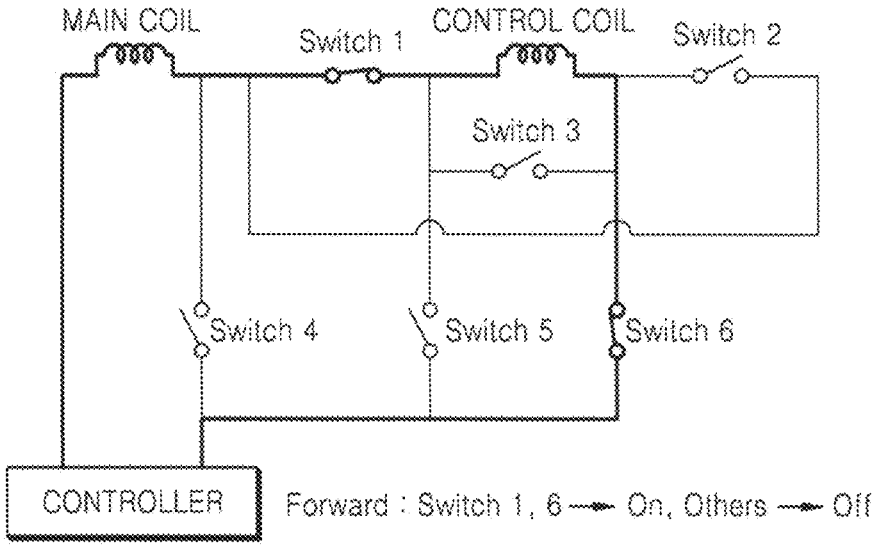
FIG. 5 illustrates an equivalent circuit configuration of a case in which a current direction of a main coil and a current direction of control coil are the same.

In the current embodiment, in order to improve the uniformity of a fusing temperature in an axis direction of the fusing roller/belt, the plurality of control coils 424, 426, and 428 are installed on the main coil 422 functioning as an excitation coil. FIG. 5 illustrates an equivalent circuit configuration of a case where the current direction of the main coil 422 and the current direction of the control coil 424 are the same. As illustrated in FIG. 5, it is possible to suppress the deterioration of the heating performance at the end portion of the coils by turning on switches 1 and 6 and turning off switches 2, 3, 4, and 5 to allow the same direction current flow through the control coil 424 and the main coil 422. The switches 1 through 6 of FIG. 5 are controlled by the controller 35. As illustrated in FIG. 5, a case where the controller 35 controls the switches 1 through 6 so that the current direction of the control coil 424 and the current direction of the main coil 422 become the same is referred to as a forward mode.

Figure 6:
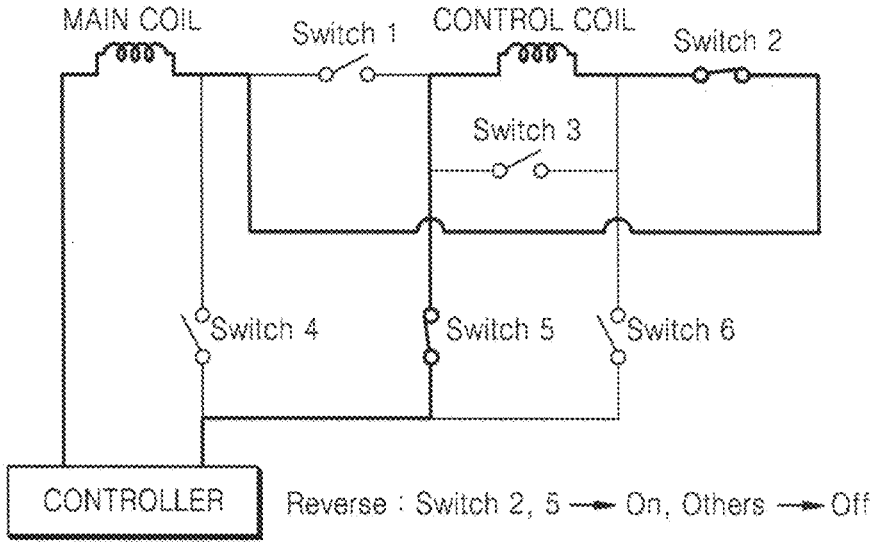
FIG. 6 illustrates an equivalent circuit configuration of a case where the current direction of the main coil and the current direction of the control coils are opposite to each other.

FIG. 6 illustrates an equivalent circuit configuration of a case in which the current direction of the main coil 422 and the current direction of the control coil 424 are opposite to each other. As illustrated in FIG. 6, the controller 35 turns on the switches 2 and 5 and turns off the switches 1, 3, 4, and 6 so that the current direction of the control coil 424 becomes opposite to the current direction of the main coil 422 when a printing paper having a small width is printed. As illustrated in FIG. 5, a case where the controller 35 controls the switches 1 through 6 so that the current direction of the control coils 424, 426, and 428 and the current direction of the main coil 422 become opposite to each other is referred to as a reverse mode.

Figure 7:
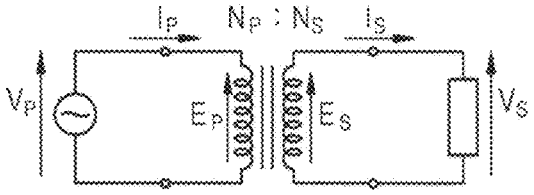
FIG. 7 is a circuit diagram of a transformer.
Figure 8:
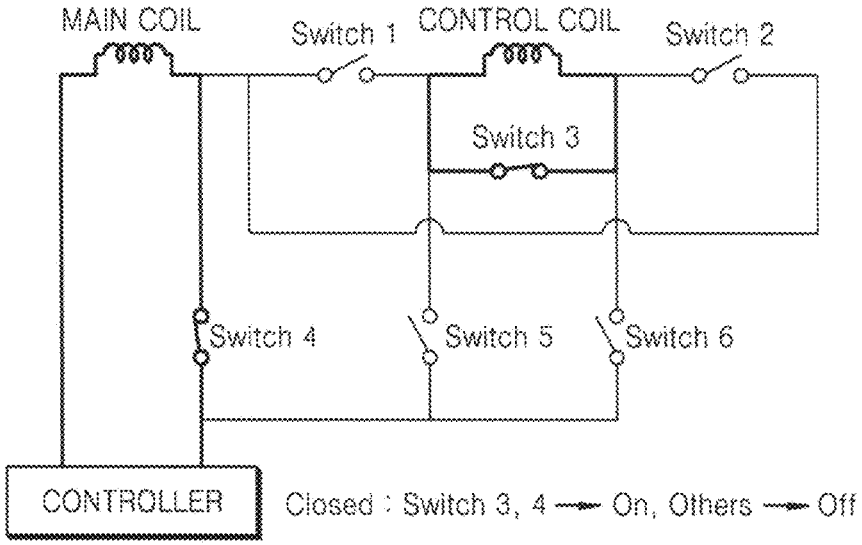
FIG. 8 illustrates a circuit configuration of a closed circuit mode to which a principal of the transformer of FIG. 7 is applied.

As another method for printing a printing paper having a small width, a principle of a transformer may be used as illustrated in FIG. 7, and in this case, a closed circuit is formed connecting the both ends of the control coil by using switching devices. That is, as illustrated in FIG. 8, the controller 35 turns on the switches 3 and 4 and turns off the switches 1, 2, 5, and 6. Thus, the control coil constitutes a closed circuit, and function as a secondary coil of a transformer. As a result, an induction current in a current direction opposite to that of the main coil is generated in the control coil due to an electromotive force of the main coil. The induction current that is generated at this time is proportional to the number of turns of the main coil. Due to this, an induction current that is somewhat larger than a current applied to the main coil may be applied to the control coils constituting the closed circuit. As illustrated in FIG. 8, a closed circuit mode refers to a case where the controller 35 controls the switches 1 through 6 so that a first closed circuit where the main coil functions as a primary coil of an transformer is formed and a second closed circuit where the control coils function as a secondary coil of the transformer is formed, and thus, an induction current in a current direction opposite to that of the main coil is generated in the control coils due to an electromotive force of the main coil.

Thus, it is possible to provide a fuser capable of supporting various types of printing papers by allowing a current in an amount equal to that of the current of the main coil flow through the control coils or allowing a current in an amount larger than that of the current of the main coil flow through the control coils depending on the width of a printing paper. For example, when a current of 18.8 ampere (A) is applied to the main coil, a current flowing through the control coils in the reverse mode is 18.8 A, and a current flowing through the control coils in the closed circuit mode is 23 A, which is larger than that flowing through the control coils.

Figure 9:
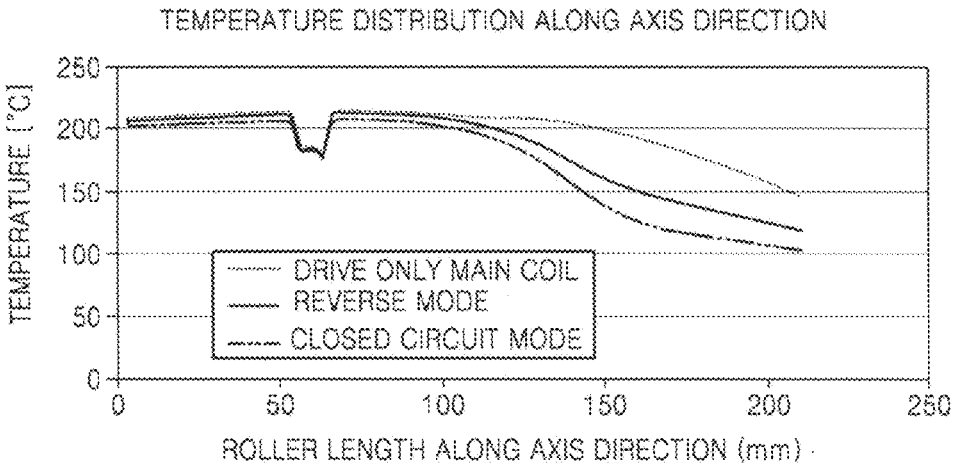
FIG. 9 illustrates a temperature distribution of an axis direction of a heating roller of FIG. 4 depending on a control coil driving mode.

FIG. 9 illustrates the temperature distribution of the axis direction of the heating roller 410 depending on a control coil driving mode. Referring to FIG. 9, when the controller 35 forms the closed circuit mode as in FIG. 8, since an effect of suppressing a generation of heating due to a current flowing through the main coil is large, the temperature of an area in which the control coils are located is maintained lower compared to that in the reverse mode like FIG. 7. Thus, it is possible to cope with various types of printing papers since the temperature distribution of the axis direction of the heating roller 410 varies depending on whether the controller 35 forms the reverse mode or the closed circuit mode.

Figure 10:
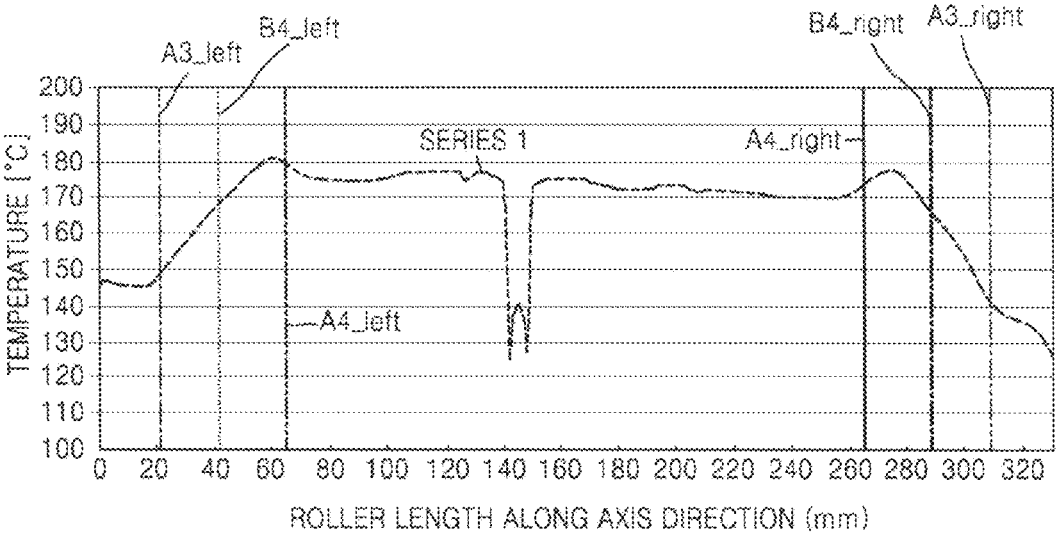
FIG. 10 illustrates a temperature distribution of the axis direction of the heating roller in a case where the control coils are not driven and only the main coil is driven.

FIGS. 10 through 14 illustrate temperature distributions of the axis direction of the heating roller 410 in cases where the control coils are applied to various modes. FIG. 10 illustrates a temperature distribution of the axis direction of the heating roller 410 in a case where the control coils are not driven and only the main coil is driven. Referring to FIG. 10, it is shown that the temperature of the both end portions of the heating roller 410 is conspicuously lowered when only the main coil is driven.

Figure 11:
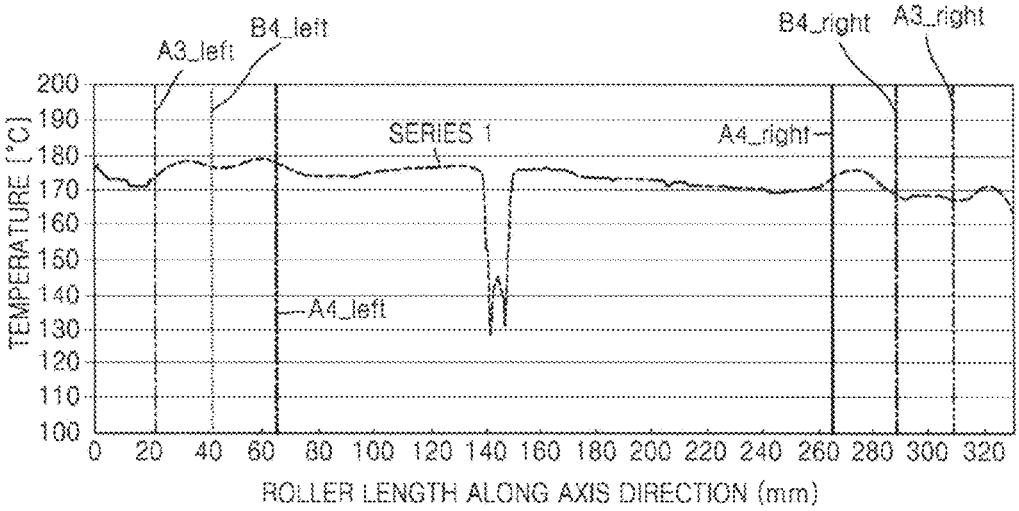
FIG. 11 illustrates a temperature distribution of the axis direction of the heating roller in a case where a first control coil is driven in a forward mode.

FIG. 11 illustrates a temperature distribution of the axis direction of the heating roller 410 in the forward mode according to the current embodiment. Referring to FIG. 11, it is shown that the temperature of the end portions of the heating roller 410 becomes a little higher than that at the center of the heating roller 410 in the forward mode where the current direction of the control coils and the current direction of the main coil become the same.

Figure 12:
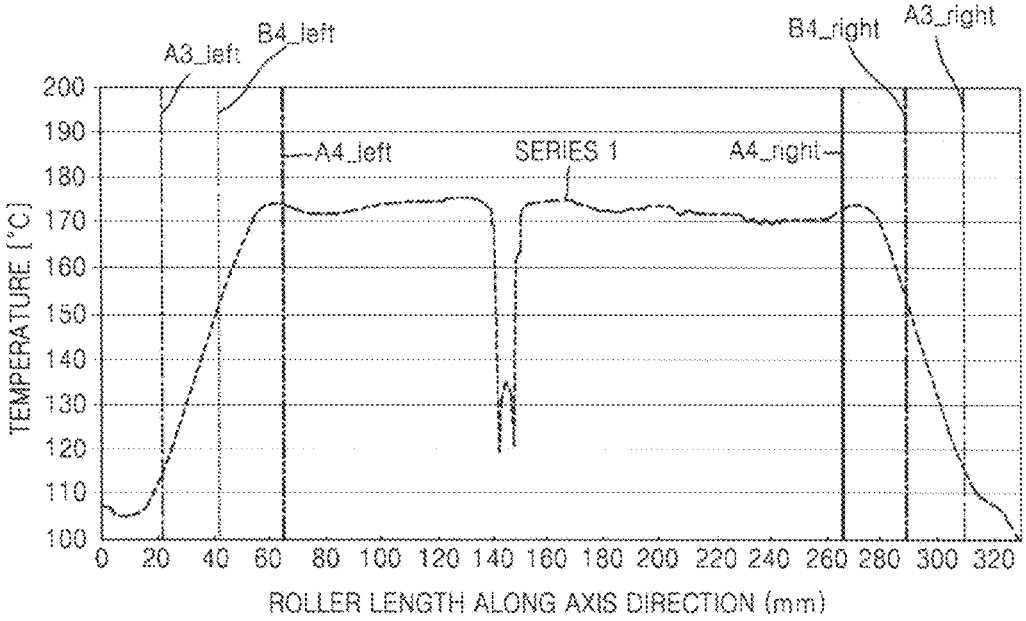
FIG. 12 illustrates a temperature distribution of the axis direction of the heating roller in a case where a first control coil is driven in a closed circuit mode.

FIG. 12 illustrates a temperature distribution of the axis direction of the heating roller 410 in the closed circuit mode according to the current embodiment. Referring to FIG. 11, it is shown that the temperature of the end portions of the heating roller 410 is conspicuously lowered compared to the temperature at the center of the heating roller 410. Thus, it may be understood that it is possible to suppress a rise in the temperature of an area of a heating roller/belt on which the printing paper does not pass also when the printing paper is narrow.

Figure 13:
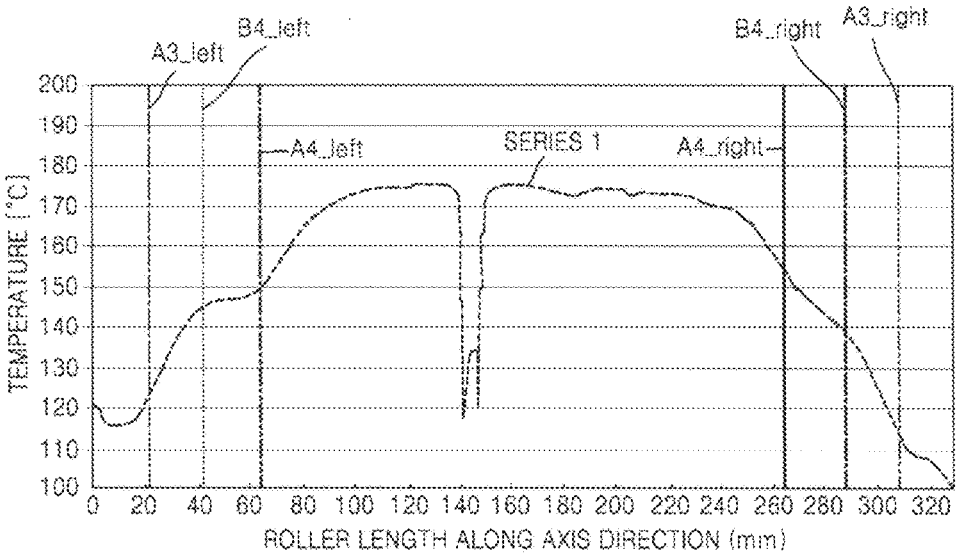
FIG. 13 illustrates a temperature distribution of the axis direction of the heating roller in a case where a first control coil and a second control coil are driven in a closed circuit mode.
Figure 14:
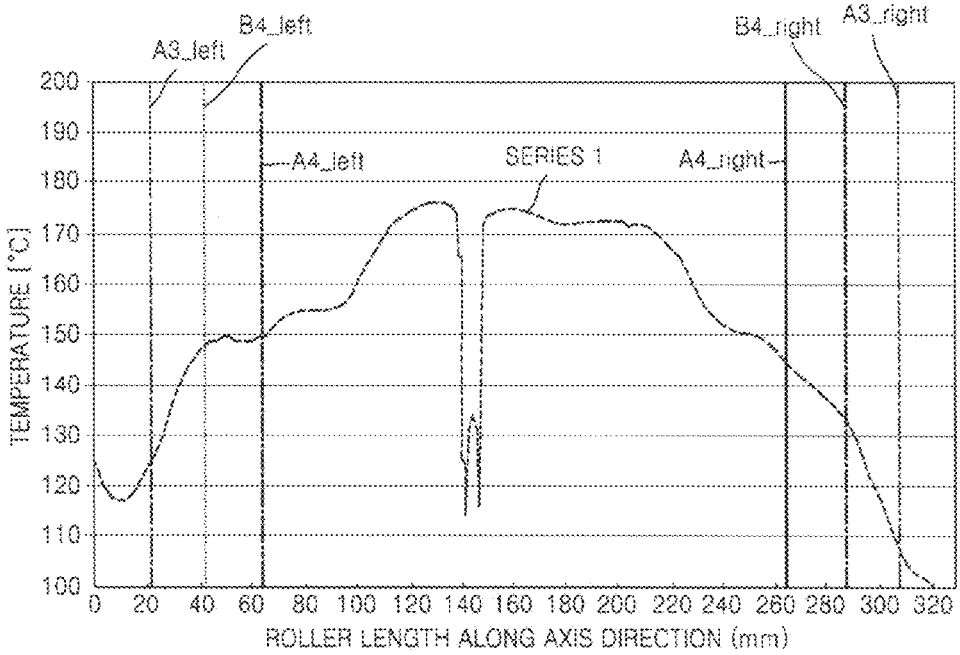
FIG. 14 illustrates a temperature distribution of the axis direction of the heating roller in a case where first through third control coils are driven in a closed circuit mode.

FIG. 13 illustrates a temperature distribution of the axis direction of the heating roller 410 in a case where a closed circuit mode including the first control coil 424 and the second control coil 426 of FIG. 4 is formed. FIG. 14 illustrates a temperature distribution of the axis direction of the heating roller 410 in a case where a closed circuit mode including the first control coil 424, the second control coil 426, and the third control coil 426 of FIG. 4 is formed.

Figure 15A:
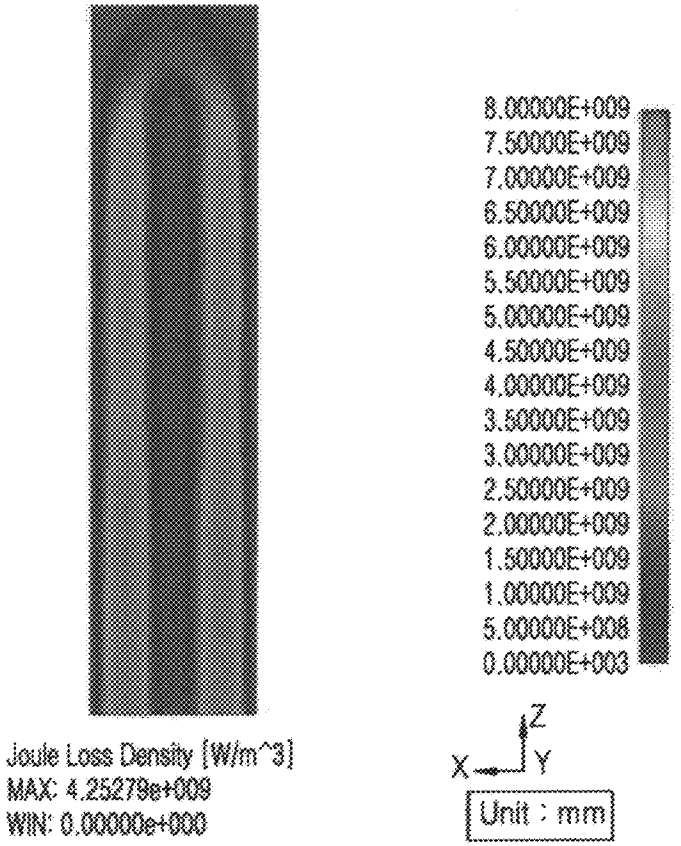
FIGS. 15A and 15B illustrate simulation results according to a variation of a temperature distribution of a heating belt depending on a driving mode of the control coils.
Figure 15B:
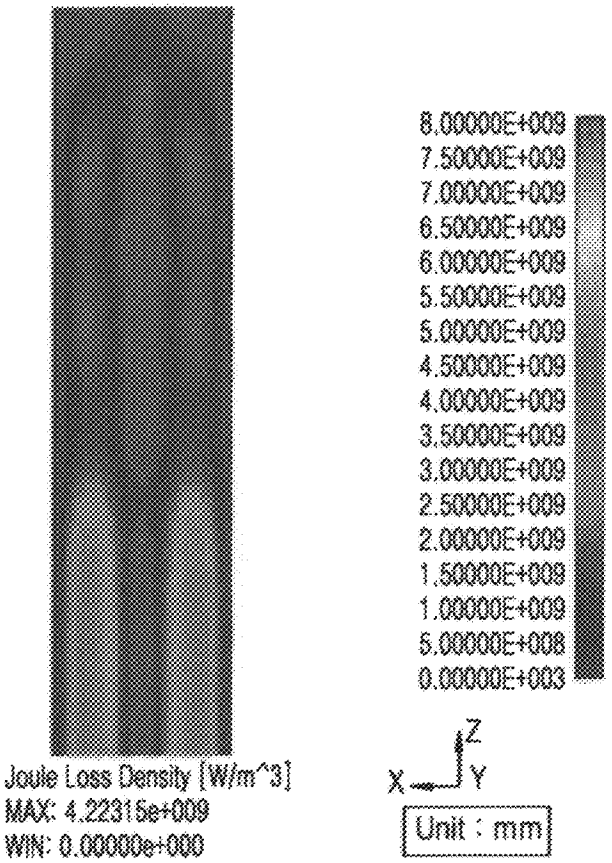

FIG. 15A illustrates a simulation result according to a variation of a temperature distribution of a heating belt in the reverse mode illustrated in FIG. 9, and FIG. 15B illustrates a simulation result according to a variation of a temperature distribution of the heating belt in the closed circuit mode illustrated in FIG. 9. Referring to FIGS. 15A and 15B, a heating portion of the heating belt appears on a shape of the main coil, and the heating portion of the heating belt is conspicuously reduced in the closed circuit mode of FIG. 15B compared to the reverse mode of FIG. 15A.

Figure 16:
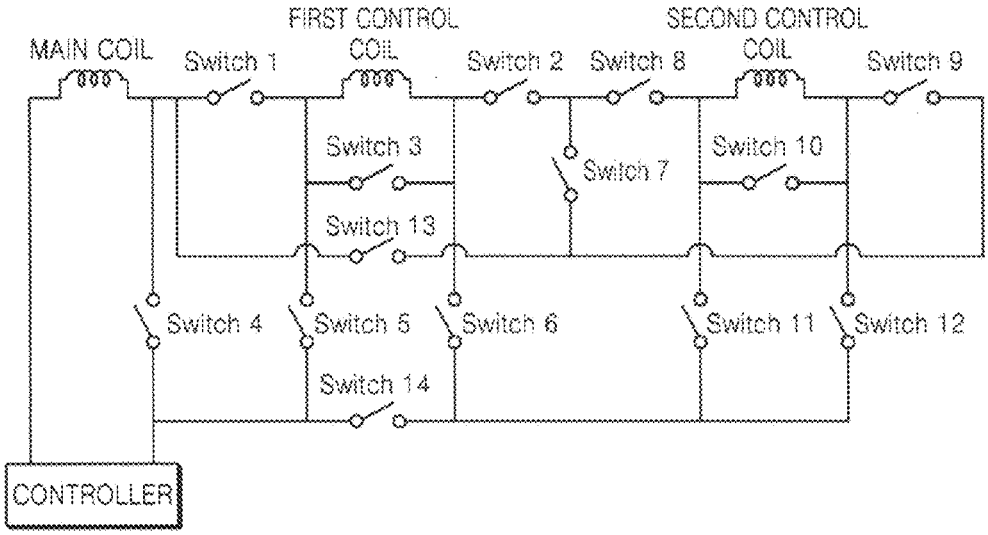
FIG. 16 illustrates a circuit configuration of a case where the first and second control coils are used.

FIG. 16 illustrates a circuit configuration of a case in which the first and second control coils 424 and 426 from among the three control coils 424, 426, and 428 illustrated in FIG. 4 are used.

Figure 17A:
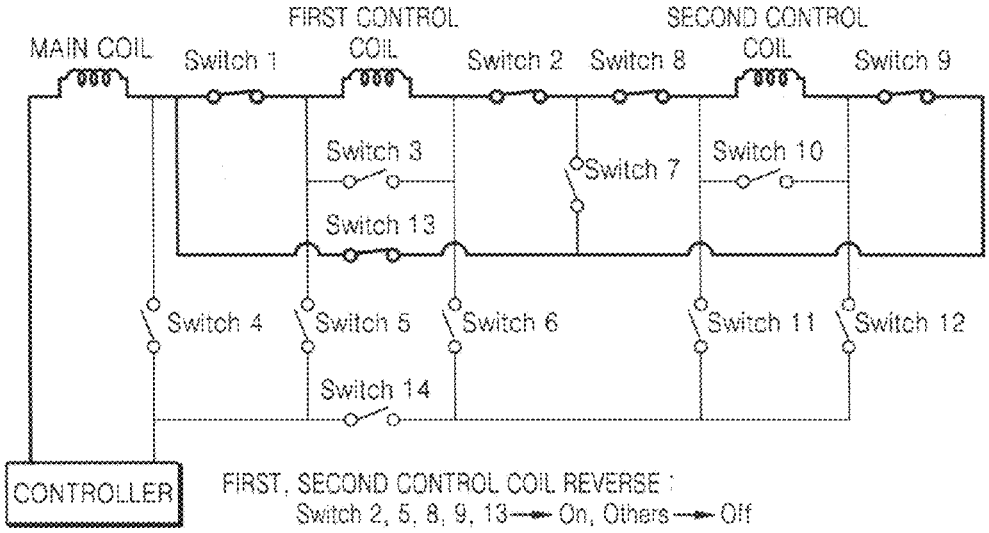
FIG. 17A illustrates an example of a circuit configuration of a case where the first and second control coils in the circuit of FIG. 16 are driven in a reverse mode.
Figure 17B:
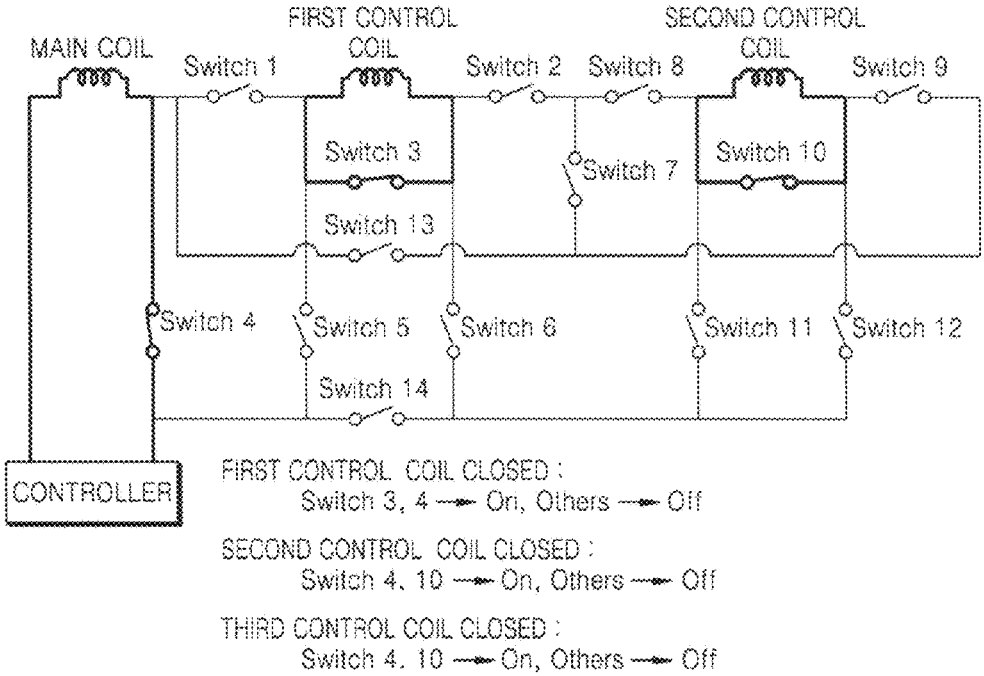
FIG. 17B illustrates an example of a circuit configuration of a case where, the first and second control coils in the circuit of FIG. 16 are driven in a closed circuit mode.

FIG. 17A illustrates an example of a circuit configuration of a case in which, in the circuit of FIG. 16, the first and second control coils 424 and 426 are driven in the reverse mode, and FIG. 17B illustrates an example of a circuit configuration of a case in which, in the circuit of FIG. 16, the first and second control coils 424 and 426 are driven in the closed circuit mode.

Figure 18:
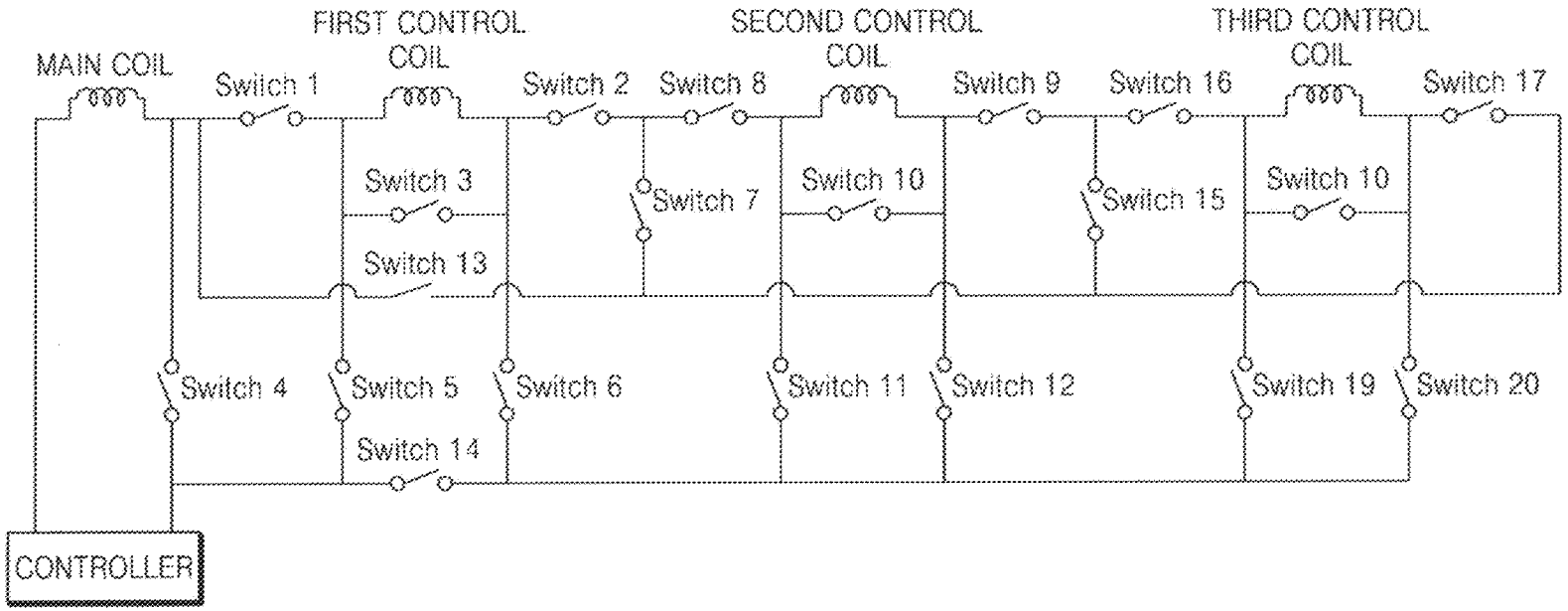
FIG. 18 illustrates a circuit configuration of a case where all of the first through third control coils are used.

FIG. 18 illustrates a circuit configuration of a case where all of the first through third control coils 424, 426, and 428 illustrated in FIG. 4 are used.

Figure 19A:
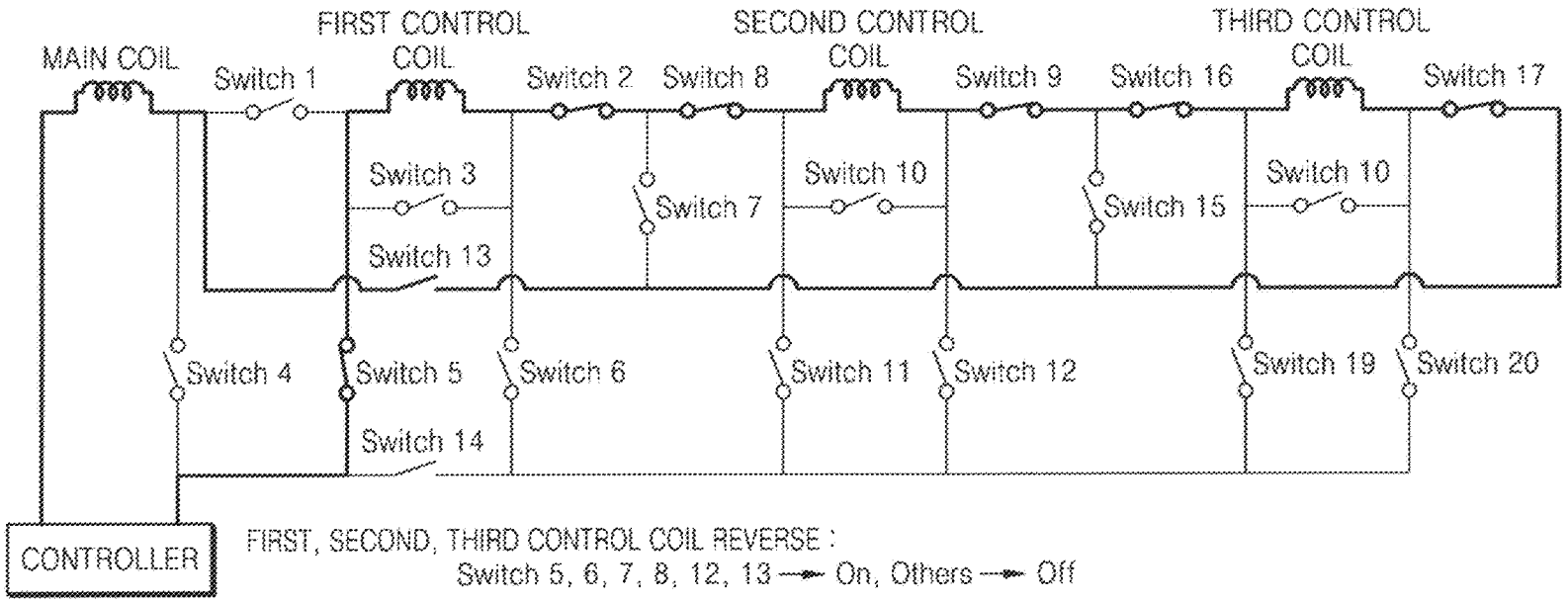
FIG. 19A illustrates an example of a circuit configuration of a case where the first through third control coils in the circuit of FIG. 18 are driven in the reverse mode.
Figure 19B:
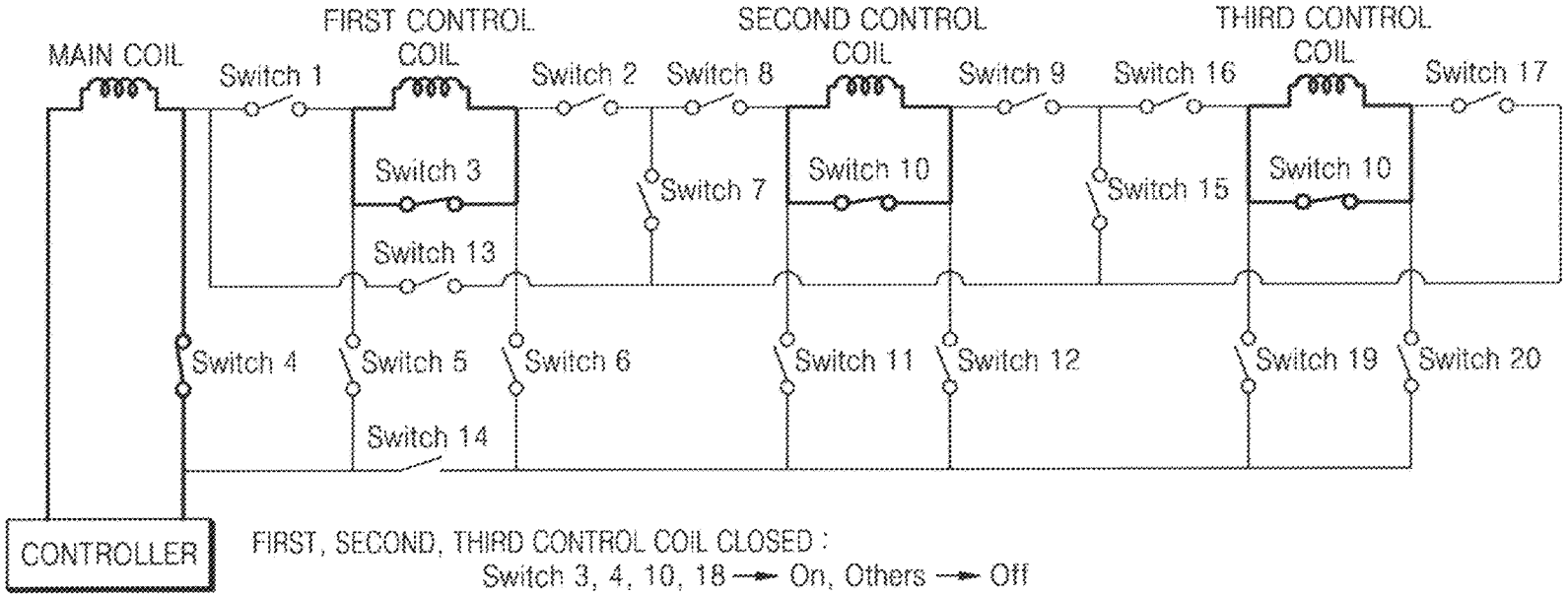
FIG. 19B illustrates an example of a circuit configuration of a case where the first through third control coils in the circuit of FIG. 18 are driven in the closed circuit mode.

FIG. 19A illustrates an example of a circuit configuration of a case where, the first through third control coils 424, 426, and 428 in the circuit of FIG. 18 are driven in the reverse mode, and FIG. 19B illustrates an example of a circuit configuration of a case where the first through third control coils 424, 426, and 428 in the circuit of FIG. 18 are driven in the closed circuit mode.

Figure 20:
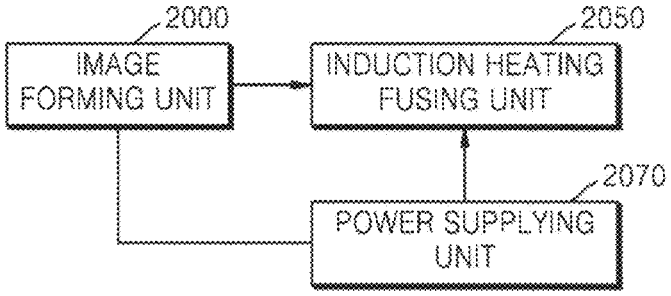
FIG. 20 is a block diagram illustrating a configuration of an image forming apparatus including an induction heating fusing device, according to an embodiment of the present general inventive concept.

FIG. 20 is a block diagram illustrating a configuration of an image forming apparatus including an induction heating fusing device, according to an embodiment of the present general inventive concept. Referring to FIG. 20, the image forming apparatus includes an image forming unit 2000, an induction heating fusing unit 2050, and a power supplying unit 2070.

The image forming unit 2000 forms a toner image and then transfers the toner image onto a printing paper. The induction heating fusing unit 2050 corresponds to the image heating fusing device of FIG. 3 according to the embodiment of the present general inventive concept. The induction heating fusing unit 2050 fuses the transferred toner image on the printing paper by using a heating element that is inductively heated and a pressure roller, depending on the width of the printing paper. As illustrated in FIG. 3, the induction heating fusing unit 2050 includes the pressure roller 310, the heating element 320, the inductor 330, and the controller 35. Since the pressure roller 310, the heating element 320, the inductor 330, and the controller 35 are the same as those illustrated in FIG. 3, an explanation thereof is omitted.

The power supplying unit 2070 supplies necessary power to the image forming unit 2000 and the induction heating fusing unit 2050.

Figure 21:
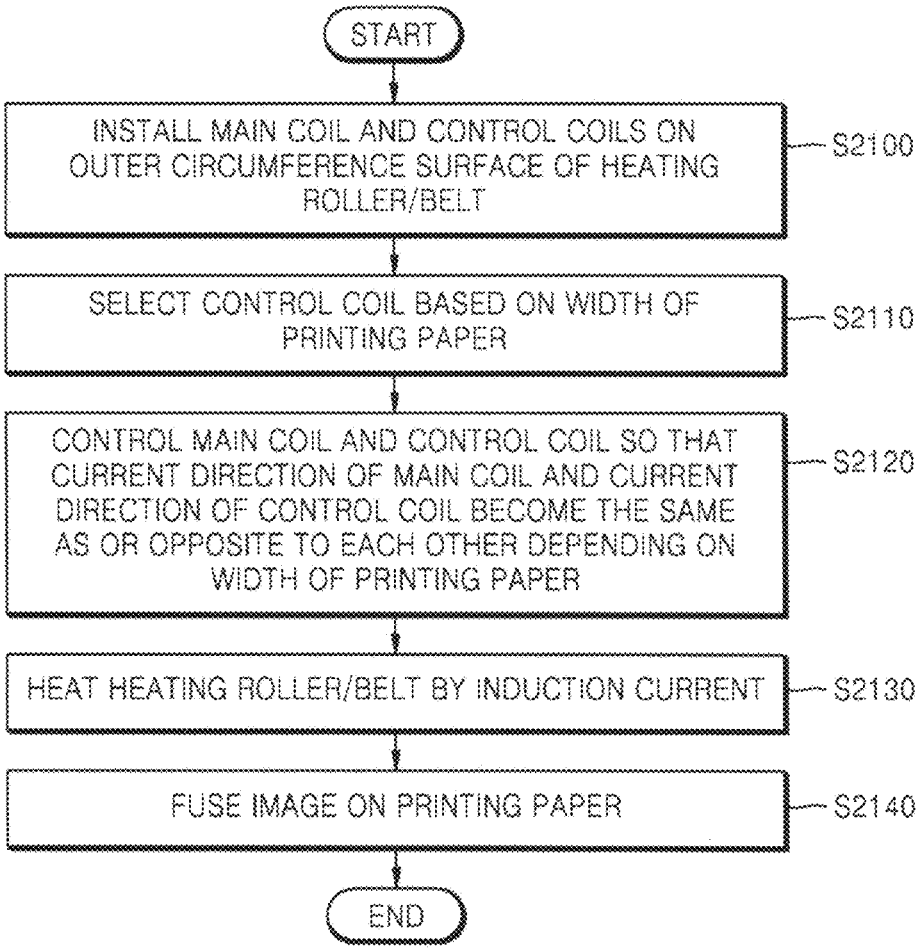
FIG. 21 is a flowchart illustrating an induction heating fusing method according to an embodiment of the present general inventive concept.

FIG. 21 is a flowchart illustrating an induction heating fusing method according to an embodiment of the present general inventive concept. The induction heating fusing method is explained with reference to FIGS. 3, 4, and 21. Referring to FIG. 21, a main coil 422 is installed in a rotation axis direction on the outer circumference surface of the heating element 320 and 410, namely, a heating roller/belt, forming a fusing nip together with the pressure roller 310 and 400, and the plurality of control coils 424, 426, and 428 are disposed in the rotation direction on the main coil 422 (operation S2100). The number of control coils may be changed depending on the width of a printing paper on which a toner image is fused in a fuser. Although three control coils are illustrated in FIG. 4, the number of control coils may be different. The heating element may be a heating roller or a heating belt.

At least one of the plurality of control coils 424, 426, and 428 is selected based on the width of a printing paper passing through the fusing nip (operation S2110). For example, the first coil 424 is selected when a printing paper having the widest width is printed, and all the first through third coils 424, 426, and 428 are selected as in FIG. 4 when a printing paper having the narrowest width is printed.

The main coil 422 and the plurality of control coils 424, 426, and 428 are controlled so that a direction of a current flowing through the main coil 422 and a direction of a current flowing through the selected at least one of the plurality of control coils 424, 426, and 428 become the same as or opposite to each other depending on the width of a printing paper (operation S2120).

The current direction of the selected at least one of the plurality of control coils 424, 426, and 428 is changed by a circuit configuration that is formed by a connection of the plurality of switching devices 352, 354, and 356 switching connections between the main coil 422 and the plurality of control coils 424, 426, and 428. In particular, when the plurality of control coils 424, 426, and 428 are driven as degaussing coils, a closed circuit including the main coil 422 and the control coils 424, 426, and 428 is formed via the plurality of switching device 352, 354, and 356. In addition, the main coil 422 and the plurality of control coils 424, 426, and 428 are operated as a primary coil and a secondary coil of a transformer, respectively, so that a current flowing through the control coils 424, 426, and 428 becomes larger than that flowing through the main coil 422.

For example, the first coil 424 may be selected and driven in the forward mode when a printing paper having the widest width is printed. All of the first through third coils 424, 426, and 428 may be selected and driven in the reverse mode or the closed circuit mode as in FIG. 4 when a printing paper having the narrowest width is printed.

After at least one of the plurality of control coils 424, 426, and 428 is selected and also a driving mode is selected, the heating element 410 is heated by an induction current generated by the selected at least one of the plurality of control coils 424, 426, and 428 (operation S2130), and an image is fused on a printing paper by pressing the printing paper via the pressure roller 400 (operation S2140).

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An induction heating fusing device comprising:

a pressure roller;

a heating element arranged to form a fusing nip together with the pressure roller and that is rotatable;

an inductor that is installed in a rotation axis direction on the outer circumference surface of the heating element, the inductor comprising a main coil and a plurality of control coils and being configured to inductively heat the heating element; and a controller comprising a plurality of switching devices that switch connections of the main coil and the plurality of control coils, the controller being configured to selectively operate at least one of the plurality of control coils depending on a width of a printing paper passing though the fusing nip, wherein a current direction in the at least one selectively operated control coil of the plurality of control coils is reversed according to an ON/OFF combination of the plurality of switching devices, and wherein the controller controls the plurality of switching devices to form the ON/OFF combination of the plurality of switching devices so that the current direction of the at least one selectively operated control coil of the plurality of control coils becomes opposite to the current direction of the main coil when the width of a printing paper passing though the fusing nip is small, and controls the plurality of switching devices to form the ON/OFF combination of the plurality of switching devices so that the current direction of the at least one selectively operated control coil of the plurality of control coils becomes the same as the current direction of the main coil when the width of a printing paper passing though the fusing nip is large.

2. The induction heating fusing device of claim 1, wherein the heating element is a heating roller or a heating belt.

3. The induction heating fusing device of claim 1, wherein the inductor comprises:

the main coil that is installed in the rotation axis direction on the outer circumference surface of the heating element, and operates as an excitation coil;

the plurality of control coils that are located on the main coil, are selectively driven depending on the width of the printing paper, and operate as excitation coils or degaussing coils depending on a current direction thereof due to the control of the controller; and a focusing core that focuses an electromagnetic field generated by a current flowing through the main coil and the plurality of control coils onto the heating element.

4. The induction heating fusing device of claim 3, wherein the focusing core comprises a ferrite.

5. The induction heating fusing device of claim 3, wherein the controller comprises:

an inductor control unit that selectively control the plurality of switching devices according to the width of the printing paper to make the current direction of the main coil and the current direction of the plurality of control coils be the same as or opposite to each other.

6. The induction heating fusing device of claim 5, wherein, when the inductor control unit drives the plurality of control coils as degaussing coils, the inductor control unit selectively controls the plurality of switching devices to constitute a closed circuit including the main coil and the plurality of control coils, and operates the main coil and the plurality of control coils as a primary coil and a secondary coil of a transformer, respectively, so that a larger current flows through the control coils.

7. An image forming apparatus comprising:

an image forming unit that forms a toner image and then transfers the toner image onto a printing paper;

an induction heating fusing unit that fuses the transferred toner image on the printing paper by using a heating element that is inductively heated and a pressure roller depending on the width of the printing paper; and a power supplying unit that supplies power to the image forming unit and the induction heating fusing unit, wherein the induction heating fusing unit comprises:

a pressure roller;

a heating element that forms a fusing nip together with the pressure roller and is rotatable;

an inductor that is installed in a rotation axis direction on the outer circumference surface of the heating element, the inductor including a main coil and a plurality of control coils, wherein the inductor inductively heats the heating element; and a controller that selectively operates at least one of the plurality of control coils depending on the width of a printing paper passing though the fusing nip, wherein a current direction in the at least one selectively operated control coil of the plurality of control coils is reversed according to an ON/OFF combination of the plurality of switching devices, and wherein the controller controls the plurality of switching devices to form the ON/OFF combination of the plurality of switching devices so that a current direction of the at least one selectively operated control coil of the plurality of control coils becomes opposite to the current direction of the main coil when the width of a printing paper passing though the fusing nip is small, and controls the plurality of switching devices to form the ON/OFF combination of the plurality of switching devices so that the current direction of the at least one selectively operated control coil of the plurality of control coils becomes the same as the current direction of the main coil when the width of a printing paper passing though the fusing nip is large.

8. The image forming apparatus of claim 7, wherein the heating element is a heating roller or a heating belt.

9. The image forming apparatus of claim 7, wherein the inductor comprises:

the main coil that is installed in the rotation axis direction on the outer circumference surface of the heating element, and operates as an excitation coil;

the plurality of control coils that are located on the main coil, are selectively driven depending on the width of the printing paper, and operate as excitation coils or degaussing coils depending on a current direction thereof due to the control of the controller; and a focusing core that focuses an electromagnetic field generated by a current flowing through the main coil and the plurality of control coils onto the heating element.

10. The image forming apparatus of claim 9, wherein the focusing core comprises a ferrite.

11. The image forming apparatus of claim 9, wherein the controller comprises:

an inductor control unit that selectively controls the plurality of switching devices according to the width of the printing paper to make the current direction of the main coil and the current direction of at least one of the plurality of control coils be the same as or opposite to each other.

12. The image forming apparatus of claim 11, wherein, when the inductor control unit drives the plurality of control coils as degaussing coils, the inductor control unit selectively controls the plurality of switching devices to constitute a closed circuit including the main coil and the plurality of control coils, and operates the main coil and the plurality of control coils as a primary coil and a secondary coil of a transformer, respectively, so that a larger current flows through the control coils.

13. An induction heating fusing method comprising:

installing a main coil in a rotation axis direction on the outer circumference surface of a heating element that forms a fusing nip together with a pressure roller, and disposing a plurality of control coils in the rotation axis direction on the main coil to inductively heat the heating element;

selecting at least one of the plurality of control coils depending on the width of a printing paper passing though the fusing nip;

controlling the main coil and the plurality of control coils so that a current direction of the main coil and a current direction of the selected at least one of the plurality of control coils become the same as or opposite to each other depending on the width of the printing paper and according to an ON/OFF combination of a plurality of switching devices; and fusing an image on the printing paper by heating the heating element via an induction current that is generated by the main coil and the selected at least one of the plurality of control coils, wherein the current direction of the selected at least one of the plurality of control coils is reversed according to an ON/OFF combination of the plurality of switches and depending on the width of the printing paper.

14. The induction heating fusing method of claim 13, wherein the heating element is a heating roller or a heating belt.

15. The induction heating fusing method of claim 13, wherein the current direction of the selected at least one of the plurality of control coils is changed by a circuit configuration that is formed by a connection of the plurality of switching devices switching connections between the main coil and the plurality of control coils.

16. The induction heating fusing method of claim 15, wherein, when the plurality of control coils are driven as degaussing coils, a closed circuit including the main coil and the plurality of control coils is constituted by using the plurality of switching devices, and the main coil and the plurality of control coils are operated as a primary coil and a secondary coil of a transformer, respectively, so that a current flowing through the control coils is larger than that flowing through the main coil.

17. An induction heating fusing device comprising:

a pressure roller;

a heating element arranged to form a fusing nip together with the pressure roller and is rotatable;

an inductor that is installed in a rotation axis direction on the outer circumference surface of the heating element, comprises a main coil and a plurality of control coils, and is configured to inductively heat the heating element;

a plurality of switches that control the current feed to the plurality of control coils such that the opening and closing the plurality of switches selectively operates at least one of the plurality of control coils depending on the width of a printing paper passing though the fusing nip;

wherein the operating of a control coil from among the plurality of control coils drives the control coil according to a configuration of the plurality of switches, and wherein the operating of a control coil from among the plurality of control coils operates the control coil as a secondary coil of a transformer such that the main coil is the primary coil of the transformer, and the current flowing through the control coil is larger than the current flowing through the main coil, according to a different configuration of the plurality of switches, and wherein the current direction of the selected at least one of the plurality of control coils is reversed according to an ON/OFF combination of the plurality of switches and depending on the width of the printing paper.

18. The induction heating fusing device of claim 17, wherein opening and closing the plurality of switches controls the main coil and the plurality of control coils so that a current direction of the main coil and a current direction of the plurality of control coils become the same as or opposite to each other depending on the width of the printing paper.

19. The induction heating fusing device of claim 17, wherein the inductor comprises:

the main coil that is installed in the rotation axis direction on the outer circumference surface of the heating element, and operates as an excitation coil;

the plurality of control coils that are located on the main coil, are selectively driven depending on the width of the printing paper, and operate as excitation coils or degaussing coils depending on a current direction thereof due to the control of the controller; and a focusing core that focuses an electromagnetic field generated by a current flowing through the main coil and the plurality of control coils onto the heating element.

20. The induction heating fusing device of claim 19, wherein the focusing core comprises a ferrite.

* * * * *

UNITED STATES PATENT AND TRADEMARK OFFICE

CERTIFICATE OF CORRECTION

PATENT NO. : 9,217,967 B2
APPLICATION NO. : 13/624171
DATED : December 22, 2015
INVENTOR(S) : Dae-hwan Kim et al.

It is certified that error appears in the above-identified patent and that said Letters Patent is hereby corrected as shown below:

On the Title Page, Item (54) and in the Specification, Column 1 (Title), Line 3
Delete "APPARAUS" and insert -- APPARATUS --, therefor.

Signed and Sealed this
Seventh Day of June, 2016

Michelle K. Lee

Michelle K. Lee
*Director of the United States Patent and Trademark Office*